US005188074A

United States Patent [19]

Kraemer et al.

[11] Patent Number: 5,188,074

[45] Date of Patent: Feb. 23, 1993

[54] FUEL INJECTION PUMP FOR INTERNAL COMBUSTION ENGINES

[75] Inventors: Manfred Kraemer, Schwieberdingen; Gerold Schultheiss, Ludwigsburg, both of Fed. Rep. of Germany

[73] Assignee: Robert Bosch GmbH, Stuttgart, Fed. Rep. of Germany

[21] Appl. No.: 910,599

[22] Filed: Jul. 8, 1992

[30] Foreign Application Priority Data

Aug. 13, 1991 [DE] Fed. Rep. of Germany ..... 4126695

[51] Int. Cl.[5] ..... F02D 33/02

[52] U.S. Cl. ..... 123/357; 123/503; 123/385

[58] Field of Search ..... 123/357, 358, 359, 502, 123/449, 503, 385, 386, 387

[56] References Cited

U.S. PATENT DOCUMENTS

| | | | |
|---|---|---|---|
| 3,724,430 | 4/1973 | Adler | 123/357 |
| 3,796,197 | 3/1974 | Locher | 123/357 |
| 3,815,564 | 6/1974 | Soda | 123/502 |
| 3,978,837 | 9/1976 | Lundberg | 123/357 |
| 4,019,478 | 4/1977 | Hobo | 123/502 |
| 4,275,691 | 6/1981 | Wolff | 123/385 |
| 4,475,519 | 10/1984 | Eheim | 123/502 |
| 4,538,581 | 9/1985 | Haransson | 123/502 |
| 4,541,393 | 9/1985 | Sato | 123/502 |
| 4,957,080 | 9/1990 | Howland | 123/386 |
| 4,972,819 | 11/1990 | Engfer | 123/385 |

FOREIGN PATENT DOCUMENTS

| | | | |
|---|---|---|---|
| 59-186436 | 1/1984 | Japan . | |
| 2185599 | 7/1987 | United Kingdom | 123/357 |

*Primary Examiner*—Carl S. Miller

*Attorney, Agent, or Firm*—Edwin E. Greigg; Ronald E. Greigg

[57] ABSTRACT

The invention is based on a fuel injection pump having an adjuster, actuatable via an adjusting mechanism; the adjusting mechanism has an adjusting piston which is displaceable in a cylinder and is adjustable counter to a restoring force by a pressure fluid. The delivery of pressure fluid to the adjusting piston is controlled via electric valves, and by means of various geometrically defined adjusting piston positions, exact injection adjustment is possible without requiring technically complicated feedback sensors on the adjuster.

4 Claims, 2 Drawing Sheets

FUEL INJECTION PUMP FOR INTERNAL COMBUSTION ENGINES

BACKGROUND OF THE INVENTION

The invention is based on a fuel injection pump for internal combustion engines. In the known fuel injection pumps of this type (Japanese Document GDS 18 64 36/84), an adjuster is actuatable by an adjusting mechanism which has an adjusting piston that is coupled to an injection adjuster and is displaced by a pressure fluid counter to a spring. The pressure fluid is regulated via electrically controlled valves; one valve each is disposed in an inlet and an outlet of the control circuit. With the aid of this controlled control circuit, it is possible to continuously adjust the adjusting piston and with it the adjuster. However, this known fuel injection pump control is very complicated and expensive. For reliable setting of a certain adjustment travel, in this case for injection onset setting, for instance, feedback of the actual position of the control mechanism is necessary. To do so with this type of pump, however, requires technically complicated feedback sensors, with the aid of which the actual and set-point states are compared continuously. Fuel injection pumps are also known (Japanese Document Gbm. 1691066/87), in which the triggering of a reciprocating slide shaft is effected via a rod linkage and electromagnets. Here, an electromagnet actuates a torsion shaft via an adjusting lever; via a plurality of small levers that each engage the groove of a control slide, the torsion shaft converts this rotary motion into an axial displacement of the control slide upon the pump piston. This type of triggering likewise requires technically complicated feedback sensors.

OBJECT AND SUMMARY OF THE INVENTION

The fuel injection pump according to the invention has the advantage over the prior art that because of the mechanically defined positions of the adjusting piston for attaining an exact setting outcome, no feedback sensors are needed. Because of the rigid mechanical structure of the adjuster, an unequivocal mechanical relationship and an exact geometric adjustment are possible. The control can be performed with the aid of a simple control circuit, embodied by simple "yes/no" signal transducers. Such a device, which is easy to make from an engineering standpoint, can meet various setting requirements and advantageously it can inexpensively provide a simple adaptation to the injection instant necessary for the applicable operating state of the engine. Because of the fixation of the adjusting piston in its outset location by a spring element, the most favorable injection onset setting for engine starting is assured reliably, regardless of the buildup of the pressure of the pressure fluid. With the aid of a control circuit, the injection onset adjustment can be done as a function of rpm, temperature, and also load. Other advantages and advantageous features of the invention can be learned from the ensuing description, drawing and claims.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
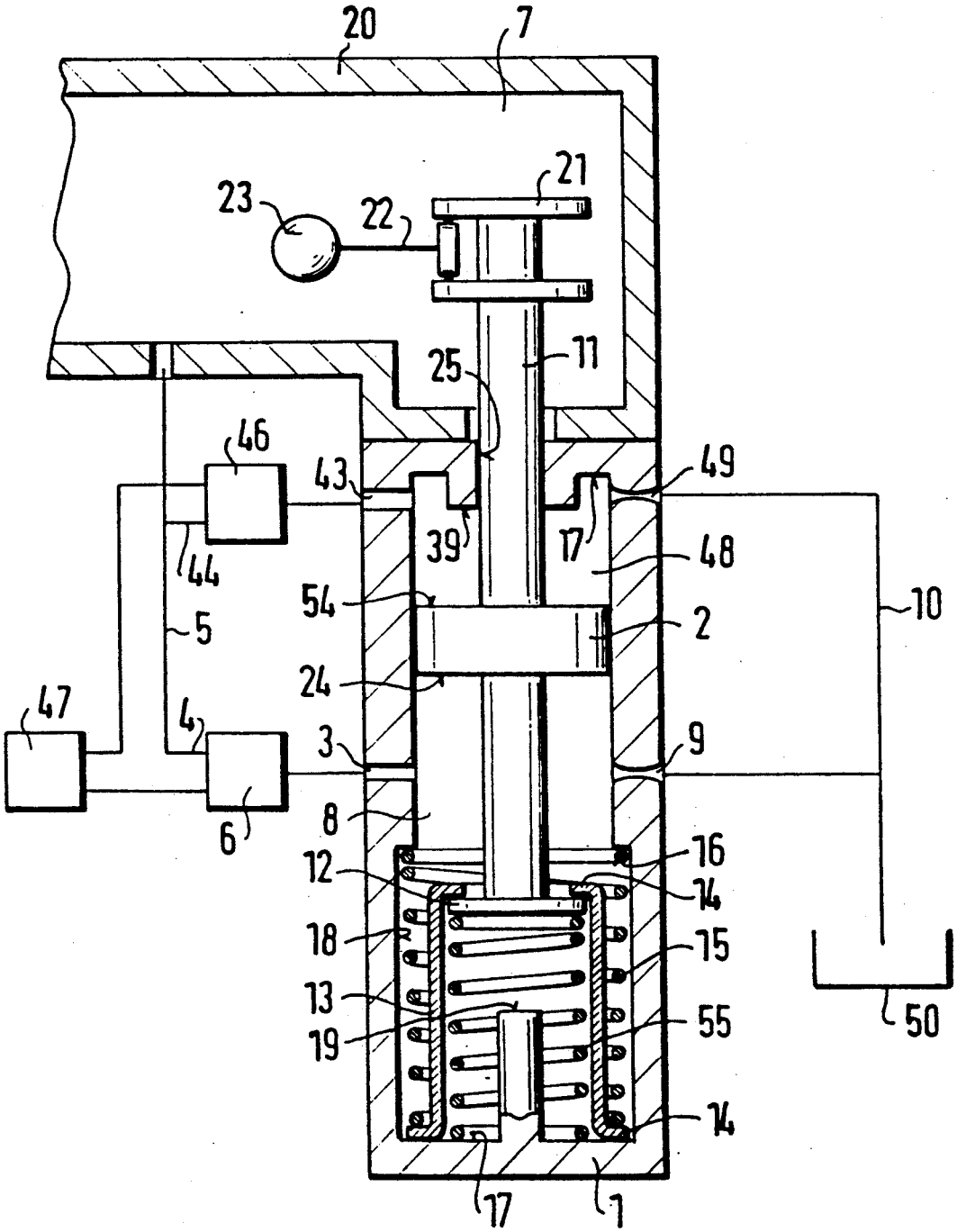
FIG. 1 shows a first exemplary embodiment of the invention, in a longitudinal section through part of a pump suction chamber of the fuel injection pump embodied in accordance with the invention and through a three-stage adjusting mechanism, shown in the outset position, with a schematically shown connection to the elements of an injection adjuster.

FIG. 1 shows a detail of a fuel injection pump for internal combustion engines, not otherwise shown, having an adjuster that is actuatable by an adjusting mechanism. This adjusting mechanism comprises an adjusting piston 2, which is coupled to an injection adjuster, displaceable in a cylinder 1, and adjustable counter to a restoring force by a pressure fluid. With its disk-like shape, with which it slides in the interior of the cylinder 1, the adjusting piston 2 divides this cylinder into a first work chamber 8 and a second work chamber 48, which are each defined on the other side by the end faces 17 of the cylinder. Discharging axially in succession into the cylindrical wall of the cylinder 1 are a first pressure fluid supply line 4, containing a first magnet valve 6, via a first inlet opening 3 into the first work chamber 8, and a second pressure fluid supply line 44, containing a second magnet valve 46, via a second inlet opening 43 into the second work chamber 48; the pressure fluid supply lines 4, 44 communicate via a common pressure fluid line 5 with a housing 20 of a pump suction chamber 7 supplied with pressure fluid, in particular fuel, preferably at rpm-dependent pressure, by a feed pump driven in synchronism with the fuel injection pump. The magnet valves 6, 46 disposed in the pressure fluid supply lines 4, 44 are controlled by a control device 47. The opposite faces of the adjusting piston 2 form a first pressure face 24 of the first work chamber 8 and a second pressure face 54 of the second work chamber 48. The first work chamber 8 can be relieved continuously via a throttle bore 9 and the second work chamber 48 can be relieved continuously via a throttle bore 49; the throttle bores 9, 49 communicate with a fuel tank 50 via a common relief line 10. A adjusting piston 2 is attached coaxially to a piston rod 11; an upper end of the piston rod protrudes into the pump suction chamber 7, guided tightly by the upper end wall of the cylinder 1. The lower end of the piston rod 11 has a flange 12 of enlarged diameter. This flange is encompassed toward the piston by a rim, forming a shoulder 14, of a sleeve 13, so that the sleeve 13 is also displaced when the adjusting piston executes an axial reciprocating motion. On its end remote from the adjusting piston 2, a rim of the sleeve 13 is bent outward, so that a shoulder 14 is created there as well. An outer compression spring 15 that surrounds the sleeve 13 is disposed in a portion 18 of enlarged diameter in the cylinder 1, and the compression spring 15 is supported at one end on the shoulder 14 of the sleeve 13 and with prestressing, on a shoulder 16 created by the widened diameter 18 provided in the cylinder wall. The sleeve 13 is pressed axially against the cylinder lower end wall 17 remote from the pump suction chamber 7 by this outer compression spring 15.

A second, inner prestressed compression spring 55 is located in the interior of the sleeve 13, supported on the lower cylinder face end 17 and acting axially against the flange 12 of the piston rod 11 guided in the sleeve 13, fastening this flange in place. In order to press the sleeve 13 against the lower cylinder bottom 17 counter to the force of the inner compression spring 55, the outer compression spring 15 must have a greater spring stiffness, or in other words must be more highly prestressed. Because of this spring arrangement, the adjusting piston 2 is retained via the piston rod 11 in a middle location between the inlet openings 3, 43; this location is equivalent to its outset position when the work chambers 8, 48 are pressureless. To limit the axial adjusting piston motion, stops 19, 39 protruding into the cylinder 1 are disposed on the lower and upper cylinder face ends 17. A mandrel-like stop 19 protruding into the first work chamber 8 serves as a support for the flange 12 of the piston rod 11, and a stop 39 protruding into the second work chamber 48 receives the piston rod 11, via a bore 25, and serves as a support for the upper pressure face 54 of the adjusting piston 2. The part of the piston rod 11 remote from the spring arrangement protrudes out of the cylinder 1 via the bore 25, into the adjoining fuel-filled pump suction chamber 7. The bore 25 is embodied such that the piston rod 11 forms a tight sliding fit with it. The part of the piston rod 11 that protrudes into the pump suction chamber 7, includes a fork 21 disposed on the upper end of the piston rod that transmits an axial motion to an adjusting lever 22 of a torsion shaft 23. If the engine begins to turn over, then a fuel pressure builds up in the pump suction chamber 7 in the fuel injection pump driven by the engine, so that the fuel is usable as an adjusting means. The fuel is delivered to the pressure fluid supply lines 5, 4, 44. When the magnet valves 6, 46, which are controlled by the control device 47, are closed, the adjusting piston 2 is held in its middle outset location by the spring arrangement described. If the first, lower magnet valve 6 is now opened, the pressure fluid flows into the work chamber 8, where it builds up a pressure. This hydraulic pressure exerts a force on the lower pressure face 24 of the adjusting piston 2 that overcomes the force of the outer compression spring 15, and as a result the adjusting piston 2 moves in the direction of the pump suction chamber. If the adjusting piston 2 is to be moved in the direction of the spring arrangement, then the magnet valve 6 closes and the second magnet valve 46 opens, and a hydraulic pressure builds up in the work chamber 48, thus moving the adjusting piston 2 in the direction of the spring arrangement, counter to the force of the inner compression spring 55. The first work chamber 8, previously filled with fuel, is thereby relieved via the throttle bore 9. The axial motion of the adjusting piston 2 is limited in both directions by the attainment of the stops 19, 39; as a result, these terminal settings of the adjusting mechanism are firmly fixed. If the adjusting piston 2 is to return to its outset position, that is, the middle location, then the delivery of pressure fluid is stopped via the appropriate magnet valve 6 or 46, so that via the continuously opened throttle bores 9, 49 the pressure fluid flows out of the filled work chamber 8, 48; both work chambers are thereby pressure-relieved, and the compression springs 15, 55 acting counter to one another via the sleeve 13 force the adjusting piston 2 into the middle location.

Figure 2:
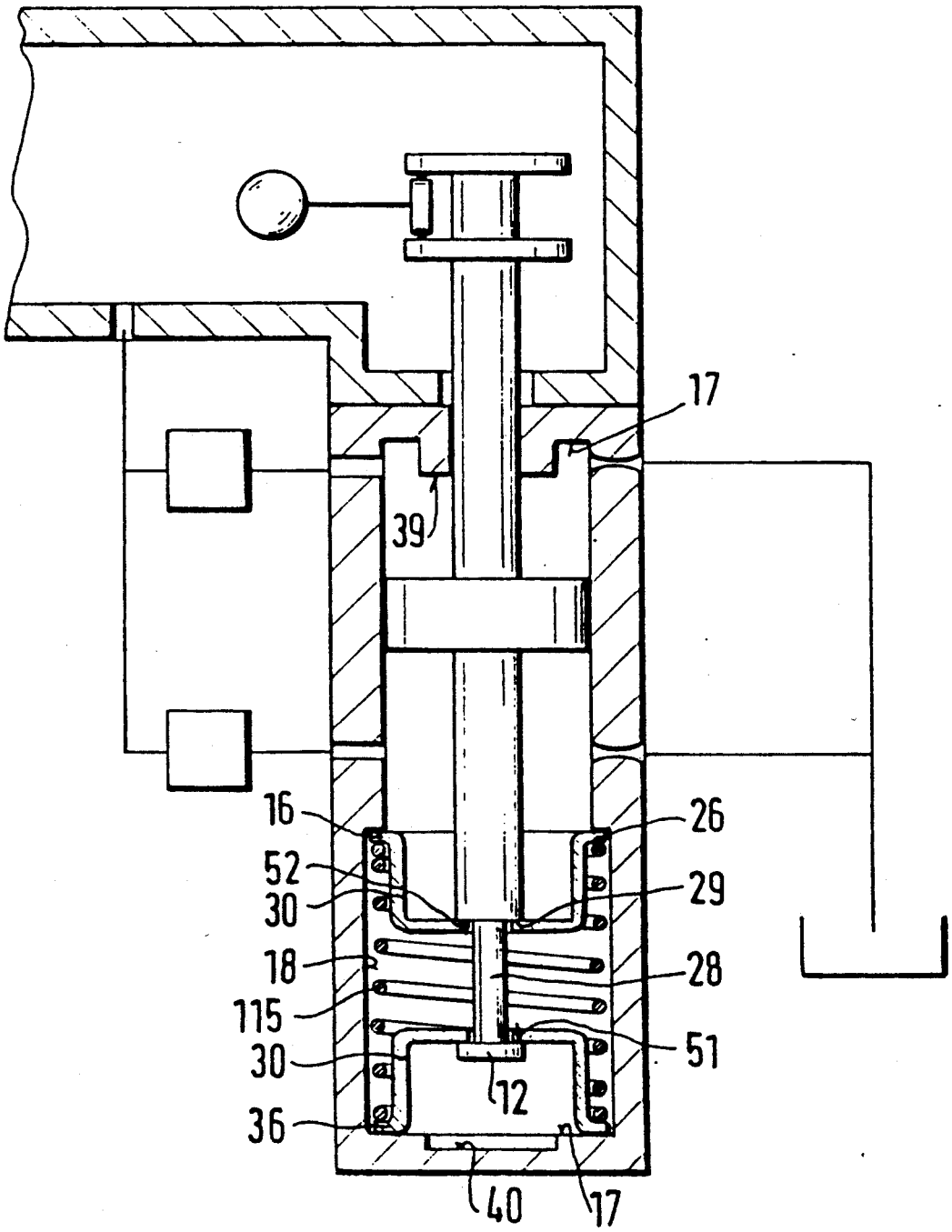
FIG. 2 shows a second exemplary embodiment of the invention, analogously to FIG. 1, but here the adjusting piston is retained in its outset position with only one spring and two spring plates.

The variant embodiment shown in FIG. 2 differs from that described in conjunction with FIG. 1 only in how the middle position of the adjusting piston 2 is fixed. Instead of the two compression springs 15, 55, only one compression spring 115 is needed here, which is guided in the portion 18 of enlarged diameter, on the side of the cylinder inner wall remote from the pump suction chamber 7. This compression spring 115 presses a first, upper spring plate 26 against the shoulder 16, and a second, lower spring plate 36 against the cylinder bottom 17. Both spring plates 26, 36 are guided on the cylinder wall via their outer diameter and are cap-shaped. The outer edges acted upon by the compression spring 115 are pressed against the shoulder 16, and the bottom wall 17; the bottoms of the cup-shaped indentations 30 of the spring plate face one another. The piston rod 11 is guided by central bores in both springs plates, and via the flange 12 it forms a stop 51 for the spring plate 36, while via a shoulder 29 created by a tapering 28 on the piston rod 11 it forms a stop 52 for the spring plate 26. Both stops 51, 52 are aligned counter to the direction of force of the compression spring 115. Since the spring force of the compression spring 115 presses the two springs plates 26, 36 apart, toward the shoulder 16, and the bottom wall 17 toward the cylinder, the adjusting piston is fixed in a middle location. The stops 51, 52 on the piston rod are spaced apart by precisely the distance required to cause the two spring plates 26, 36 to contact the shoulder 16, and the bottom wall 17 toward the cylinder. To that end, the flange 12, along with the tapered part 28 of the piston rod 11, is embodied preferably as a screw connection, which makes later adjustment possible. The mode of operation of the exemplary embodiment of FIG. 2 is analogous to that described for FIG. 1, except that the restoring force to be overcome is provided here in both directions by one compression spring 115, which results in a uniform exertion of force in both directions. In this exemplary embodiment as well, the terminal locations of the adjuster are geometrically fixed by stops 39, 40 for the adjusting piston 2, so that feedback members can be dispensed with. The geometrically firmly fixed outset location of the adjusting piston 2 in the middle position provides a favorable injection adjustment location for the starting process of some engines. Moreover, factors that interfere with the stability of a given adjusted location are averted by means of the geometrically exactly defined piston positions.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A fuel injection pump for internal combustion engines having an adjuster that is actuatable by an adjusting mechanism, the adjusting mechanism includes an adjusting piston (2) that is coupled to the adjuster, the adjusting piston is displaceable in a cylinder (1), and defines a first work chamber (8), below said piston and a second work chamber (48) above said piston, the piston is adjustable counter to a restoring force by a pressure fluid that is delivered to the first work chamber (8) via a pressure fluid supply line (4) and an electrically controlled valves in the pressure fluid supply line (4), the valves (6) and (46) are controlled by an electrical control device, and the adjusting piston (2) is placed in an outset position by the restoring force, the adjusting piston (2) is secured on a piston rod coaxially in a cylinder (1), the lower and upper work chambers act in opposite directions upon the adjusting piston (2) when separately controlled via respective pressure fluid supply lines (4, 44) containing the electrically controlled valves (6, 46) and the lower and upper work chambers are relieved separately via respective throttles (9, 49), and the adjusting piston (2) is held in a middle outset location by a spring arrangement.

2. A fuel injection pump as set forth in claim 1 in which said spring arrangement includes at least one prestressed spring.

3. A fuel injection pump as defined by claim 1, in which one end of the piston rod (11) includes a flange (12), the spring arrangement comprises a first prestressed spring (15), which is axially supported at one end directly on a cylinder wall shoulder (16) and at the other end via a sleeve (13) on the cylinder (1) supported on a bottom face of the cylinder, and a second prestressed compression spring (55), which is supported directly axially within the cylinder (1) with one end supported on the bottom wall and at the other end on the flange (12) connected to the piston rod (11), the two prestressed compression springs (15, 55) being disposed coaxially with respect to one another.

4. A fuel injection pump as defined by claim 1, in which the spring arrangement comprises a prestressed compression spring (115), which is axially supported at one end on a cylinder wall shoulder (16) via a first spring plate (26) and at the other end on the lower cylinder face via a second spring plate (36), and in the outset position of the adjusting piston (2), the first spring plate (26) comes to rest in an operative direction of a spring prestressing force on a first stop (52) on a part (28) joined to the adjusting piston rod (11), and the second spring plate (36) comes to rest, in an operative direction of a spring prestressing force, on a second stop (51) of the part (28) joined to the adjusting piston rod (11), and the spring plates (26, 36) are displaceable relative to one another on the part (28) located between the stops (51, 52).

* * * * *